United States Patent [19]

Angevine et al.

[11] 4,450,067

[45] May 22, 1984

[54] DISTILLATION-INDUCED EXTRACTION PROCESS

[75] Inventors: Philip J. Angevine, West Deptford; Michael B. Carroll, Mantua; Stuart S. Shih, Cherry Hill; Samuel A. Tabak, Wenonah, all of N.J.

[73] Assignee: Mobil Oil Corporation, New York, N.Y.

[21] Appl. No.: 259,113

[22] Filed: Apr. 30, 1981

[51] Int. Cl.[3] ..... C10G 21/02; C10C 3/08

[52] U.S. Cl. ..... 208/86; 208/309; 208/311; 208/320

[58] Field of Search ..... 208/309, 311, 320, 86

[56] References Cited

U.S. PATENT DOCUMENTS

| | | | |
|---|---|---|---|
| 3,291,718 | 12/1966 | Biribauer et al. | 208/36 |
| 3,627,675 | 12/1971 | Ditman | 208/309 |
| 4,125,458 | 11/1978 | Bushnell et al. | 208/309 |
| 4,305,812 | 12/1981 | Shih et al. | 208/309 |

*Primary Examiner*—G. L. Kaplan
*Assistant Examiner*—William Leader
*Attorney, Agent, or Firm*—Alexander J. McKillop; James F. Powers, Jr.; Howard M. Flournoy

[57] ABSTRACT

A process for multi-solvent extraction is provided wherein polarity gradients induced by distillation are utilized for the extraction of petroleum residua and other heavy oils whereby a high quality maltenic fraction and a lower quality asphaltenic fraction are obtained.

7 Claims, 2 Drawing Figures

SCHEMATIC DIAGRAM OF DISTILLATION-INDUCED POLARITY GRADIENT EXTRACTION

DISTILLATION-INDUCED EXTRACTION PROCESS

BACKGROUND OF THE INVENTION

1. Field of the Invention

This invention is directed to a novel concept wherein polarity gradients are induced by a distillation process whereby enhanced multi-solvent extraction of petroleum residua and heavy oils produces low CCR maltenic fractions and high CCR asphaltenic fractions. This invention is further directed to the use of a distillation separatory process to establish a concentration gradient between a high polarity and a low polarity solvent within an extraction column, said polarity gradient acting to enhance distinct partitioning of CCR (Conradson Carbon Residue), metals, nitrogen and sulfur during the extractive separation of the asphaltenic and maltenic fractions of petroleum residua or other heavy oil.

2. Description of the Prior Art

Solvent extraction is a well known process in the refining of petroleum, being established as early as 1911. Solvent extraction is used in the petroleum refining industry for a multitude of purposes such as upgrading charge stocks for catalytic cracking operations.

Solvent deasphalting is also a well-known operation in refineries today. The primary objective of deasphalting is to separate a petroleum stream into a relatively high quality fraction ("deasphalted oil" or "maltenes") and a lower quality fraction ("asphalt" or "asphaltenes"). The asphaltenes are generally higher in aromaticity, Conradson Carbon Residue (CCR), molecular weight, and heteroatom (S N, Ni, V, Fe, etc.) content. Solvent deasphalting may also be thought of as a simple form of compositional delineation. Many methods are currently available for separating hydrocarbons into more distinct compositional groups. An example of such a method is gradient elution chromatography (GEC), where a sequence of increasingly polar solvents are used to isolate various hydrocarbon types. In contrast to these prior art methods this invention utilizes a process of distillation to isolate various hydrocarbon fractions.

As light crude stocks become less available, refineries are turning to heavier crude stocks for gasoline and distillate production. However, these heavier crudes result in increased quantities of high CCR, hard to process vacuum residua. This extraction process will allow the vacuum residua to be sharply cut to give maximum yield of a low CCR maltenic fraction suitable for catalytic cracking. The high CCR material will be concentrated into an asphaltenic cut which can then be coked or hydroprocessed and catalytically cracked. In the case of a resid HDT/FCC process, this will decrease the volume charged to the hydrotreater and subsequently reduce hydrogen consumption. Further, integration of Polarity Gradient Extraction into an existing refinery will permit processing of varied quality crudes. This process, due to its infinitely variable polarity gradient, can cut a stream to any yield or quality specification as required for downstream processing. Thus, with proper selection of solvents it is possible to partition the heteroatoms and CCR of a hydrocarbonaceous material in a manner analogous to disproportionation.

SUMMARY OF THE INVENTION

The novel process disclosed herein is based on a concept which produces a solvent concentration gradient for enhanced multi-solvent extraction of petroleum residua and heavy oils comprising the use of a distillation system whereby the need for solvent distillation is eliminated by sharper separation, than heretofore possible using single solvent extraction. Increased yield of maltenic phase at a given CCR level is obtained which allows "fine tuning" of the separation by the number of solvents used, the polarity of solvents used, solvent flow rate and rate of heat input/output to the distillation reboiler and/or condenser. A maltenic phase, low in CCR and heteroatom content suitable for direct upgrading such as FCC is produced by the process embodied herein.

DESCRIPTION OF SPECIFIC EMBODIMENTS

Figure 1:
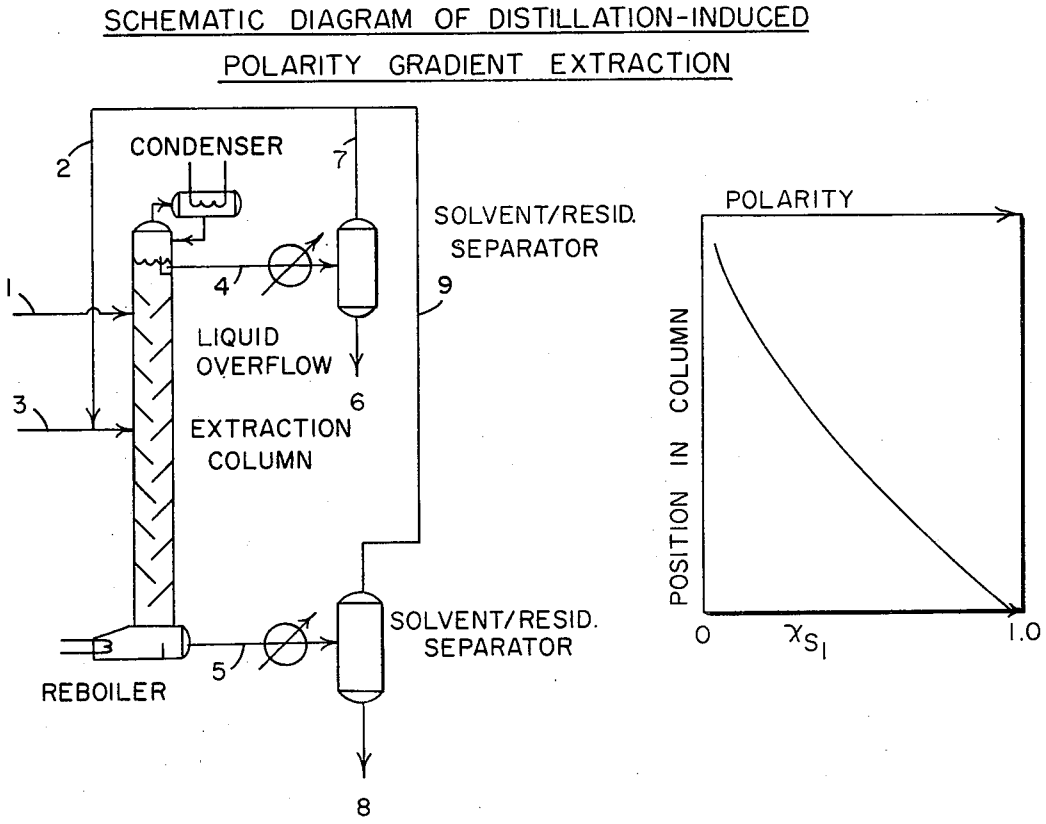
FIG. 1 is a schematic diagram of distillation-induced polarity gradient extraction.

Distillation induced polarity gradient extraction operates, generally speaking, by injecting residua and two (or more) solvents into a liquid flooded column. This column is similar to a distillation column, containing packing or other internals for vapor/liquid distribution, however it operates in a liquid-continuous manner. Thus, there is both upflow and downflow of the liquid phase. The solvent mix is chosen such that their boiling points are much lower than the residua, and that they can be distilled into high and low polarity fractions, a reboiler and condenser establishes a temperature gradient and, consequently, a concentration and polarity gradient through the column.

The resid or other heavy oil is injected into the upper part of the column where it fractionates into a maltenic and asphaltenic phase. The maltenic phase is then carried up column by mass flow while the asphaltenic phase precipitates down column due to the density difference between the asphaltenes and the solvent. The polarity gradient formed then acts as a driving force for the residua extraction. The net effect is to produce an overhead stream enriched with low CCR maltenic material, and a bottoms enriched with high CCR asphaltenic material. Overhead and bottoms solvents are removed by flash distillation and recycled. If desired, side draw streams may be taken at any point in the column. In addition, for cases where the bottoms stream contains precipitate, a settler may be used to further cut the bottoms fraction.

As mentioned herein previously, the solvent polarity gradient in the extractor is established by the composition gradient of the solvent and/or temperature gradient in the extractor. This solvent polarity gradient provides the ability for continuous extraction and the flexibility to control the quality of extract from the top of the extractor. The following specific illustrations of the above-disclosed process are representative of the benefits achieved thereby and are meant only to be representative not limiting with respect to the inventive process.

Any suitable heavy oil or residua may be used in this process, the following is a non-exclusive list of suitable solvents:

Examples of Two Solvents

Propane—Toluene
Butane—Toluene

Pentane—Toluene
Hexane—Toluene
Propane—Pyridine
Butane—Pyridine
Pentane—Pyridine
Propane—Cyclopentane
Butane—Cyclopentane
Propane—Cyclohexane
Butane—Cyclohexane
Pentane—Cyclohexane Examples of More Than Two Solvents Propane—Cyclopentane—Toluene
80°-170° F. light straight run petroleum naphtha—200° F.+ heavy reformate
80°-170° F. FCC gasoline—200° F.+ heavy reformate
Mixed LPG—Toluene
Mixed LPG—Cyclohexane
Mixed LPG—200° F.+ reformate
Propane—Cyclopentane—Pyridine
Propane—Cyclohexane—Pyridine
Propane—Cyclohexane—Toluene
Propane—Hexane—Toluene
Propane—Pentane—Cyclohexane Other highly suitable solvents include dimethyl formamide, a 50/50 blend of dimethyl formamide and pentane, a 50/50 blend of dimethyl formamide and heptane, glacial acetic acid, phenol, pentane, heptane, and suitable refinery streams admixed in at least a 50/50 ratio by weight of refinery stream to said solvents or solvent blends.

Generally speaking, the solvents and the residua, for example, Arabian light, are mixed in a 40:1 to 1:1 ratio. Preferred is a ratio of 20:1 to about 10:1 of solvent to residua at room temperature. However, any convenient temperature and pressure may be used.

The following legend is in reference to FIG. 1

1. Vacuum Resid
2. Recycle Solvents $S_1$ and $S_2$
3. Makeup Solvents $S_1$ and $S_2$
4. Stream rich in Solvent $S_2$ and Deasphalted Resid
5. Stream rich in Solvent $S_1$ and Extracted Asphalt
6. Deasphalted Resid Fraction
7. Stream rich in Solvent $S_2$.
8. Asphaltic Resid Fraction
9. Stream rich in Solvent $S_1$
10. $X_{s1}$ is the mole fraction or weight percentage of solvent $S_1$ Polarity $S_1$ is greater than Polarity $S_2$ Boiling Pt. $S_1$ is greater than Boiling Pt. $S_2$ Volume of Liquid Overhead (4) is greater than volume of Liquid Bottoms (5)

Figure 2:
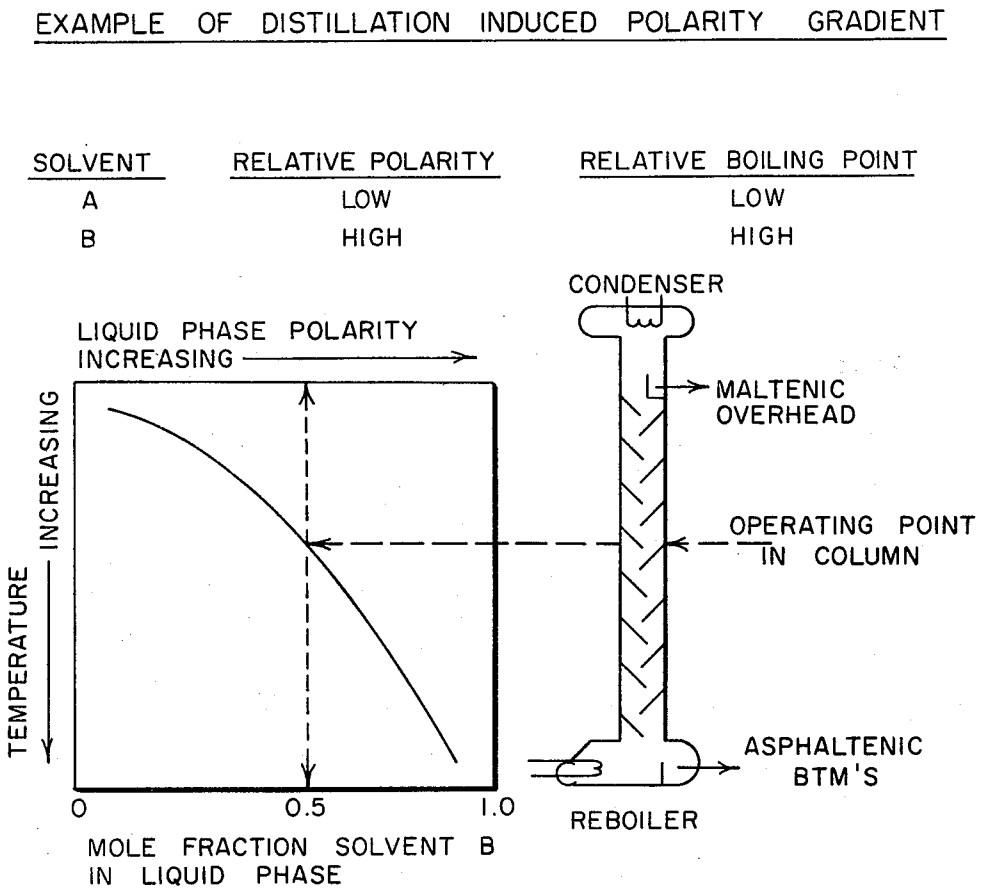
FIG. 2 is an example of distillation-induced polarity gradient in accordance with the invention.

FIG. 2 is an illustrative example of the distillation induced polarity gradient process in accordance with this invention.

As previously pointed out, the net effect of the process is to produce an overhead stream enriched with low CCR maltenic material and a bottoms enriched with high CCR asphaltenic material. The overhead and bottoms solvents are removed by flash distillation or other convenient means and recycled.

We claim:

1. An improved method of producing low CCR maltenic fractions and high CCR asphaltenic fractions from hydrocarbonaceous residua and other heavy oils by multisolvent-distillation-induced polarity gradient extraction comprising contacting two or more suitable solvents with said residua in a liquid flooded distillation column operating in a liquid continuous mode, said solvents having a high and a low boiling point with respect to one another, said higher boiling solvent having a higher relative polarity than said lower boiling solvent and each of said boiling points being sufficiently lower than that of the residua so that the solvents are distillted into high and low polarity fractions thereby forming a low CCR maltenic overhead stream and a high CCR asphaltenic bottoms stream and thereafter recovering the solvents from the overhead stream and the bottoms stream, and recycling the solvents for reuse.

2. The method of claim 1 wherein the solvents are selected from the group consisting of dimethyl formamide: 50/50 blend of dimethyl formamide and pentane; pentane; 50-50 blend of dimethyl formamide and heptane; heptane; glacial acetic acid, phenol, pyridine, toluene, mixtures of the above and suitable refinery streams admixed in at least a 50-50 ratio by weight of refinery stream to said solvents or solvent blends.

3. The method of claim 1 wherein the ratio of residua to solvent is about 1 to 20 at room temperature.

4. The method of claim 1 wherein the hydrocarbonaceous residua to be fractionated is a lubricating oil chargestock.

5. A process for preparing feedstock suitable for use in conventional refinery cracking processes wherein the hydrocarbonaceous residua is processed in accordance with the method of claim 1 and the low CCR stream is thereafter sent to a cracking unit.

6. A process for preparing feedstock suitable for use downstream in thermal processing units comprising treating petroleum residua or other heavy oils in accordance with the method of claim 1 and thereafter recovering and adapting the resultant high CCR stream for use in said thermal processing units.

7. A process for preparing feedstock suitable for use downstream in conventional refinery upgrading units comprising treating petroleum residua or other heavy oils in accordance with claim 1 and thereafter recovering both the high CCR stream and the low CCR stream for use in said suitable conventional upgrading units.

* * * * *